US007589705B2

(12) United States Patent
Leo et al.

(10) Patent No.: US 7,589,705 B2
(45) Date of Patent: Sep. 15, 2009

(54) CIRCUIT AND METHOD FOR DRIVING DISPLAY PANEL

(75) Inventors: Hon Yuan Leo, Tainan County (TW); Lin Kai Bu, Hsinhua (TW); Yung Yuan Ho, Tainan County (TW)

(73) Assignees: Himax Display, Inc., Tainan County (TW); Himax Technologies, Inc., Tainan County (TW)

( * ) Notice: Subject to any disclaimer, the term of this patent is extended or adjusted under 35 U.S.C. 154(b) by 728 days.

(21) Appl. No.: 11/183,811

(22) Filed: Jul. 19, 2005

(65) Prior Publication Data

US 2006/0209498 A1 Sep. 21, 2006

(30) Foreign Application Priority Data

Mar. 15, 2005 (TW) ..... 94107811 A

(51) Int. Cl.
*G09G 3/36* (2006.01)

(52) U.S. Cl. ..... 345/90; 345/98; 345/99; 345/100

(58) Field of Classification Search ..... 345/87, 345/90, 98–100
See application file for complete search history.

(56) References Cited

U.S. PATENT DOCUMENTS

| | | | | |
|---|---|---|---|---|
| 6,521,475 | B1 * | 2/2003 | Chen et al. | 438/34 |
| 6,756,962 | B1 * | 6/2004 | Akimoto et al. | 345/98 |
| 7,102,608 | B2 * | 9/2006 | Bu | 345/98 |
| 7,136,039 | B2 * | 11/2006 | Bu et al. | 345/98 |
| 7,206,234 | B2 * | 4/2007 | Pan et al. | 365/194 |
| 2002/0063590 | A1 * | 5/2002 | Nanba et al. | 327/170 |
| 2003/0001632 | A1 * | 1/2003 | Anderson et al. | 327/112 |
| 2003/0234757 | A1 * | 12/2003 | Bu | 345/90 |
| 2003/0234758 | A1 * | 12/2003 | Bu et al. | 345/90 |

* cited by examiner

*Primary Examiner*—Henry N Tran
*Assistant Examiner*—Viet Pham

(57) ABSTRACT

A circuit for driving a display panel comprises a source driving circuit having a plurality of driving units for driving the display panel according to display data; at least one of the driving units has a buffer and a switch circuit wherein the buffer includes an input terminal and an output terminal, and the switch circuit is coupled to the buffer and used for selectively and electrically connecting the output terminal of the buffer and the display panel, electrically connecting the input terminal of the buffer and the display panel, or electrically disconnecting the buffer and the display panel. The present invention also provides a method for driving a display panel.

19 Claims, 7 Drawing Sheets

CIRCUIT AND METHOD FOR DRIVING DISPLAY PANEL

CROSS REFERENCE TO RELATED APPLICATIONS

This application claims the priority benefit of Taiwan Patent Application Serial Number 094107811, filed on Mar. 15, 2005, the full disclosure of which is incorporated herein by reference.

BACKGROUND OF THE INVENTION

1. Field of the Invention

This invention generally relates to a circuit and method for driving a device, and more particularly to a circuit and method for driving a display panel.

2. Description of the Related Art

FIG. 1 shows a schematic diagram of a conventional TFT LCD (thin-film-transistor liquid crystal display) device 10. The LCD device 10 includes an LCD panel 12, a control circuit 14, a first driving circuit 16, a gate driving circuit 18 and a power supply circuit 22. The LCD panel 12 is composed of two substrates and a liquid crystal layer interposed between the two substrates. A plurality of data lines 24, a plurality of gate lines 26 perpendicular to the data lines 24, and a plurality of thin film transistors 28 arranged as a transistor array are disposed on one of the two substrates. The transistors 28 arranged at each column in the transistor array have their sources electrically connected to each of the data lines 24, and the transistors 28 arranged at each row in the transistor array have their gates electrically connected to each of the gate lines 26. In addition, a capacitor 30 is formed between the drain of the transistor 28 and a common voltage VCOM. The power supply circuit 22 and the first driving circuit 16 are constructed as a source driving circuit.

After the control circuit 14 receives a horizontal synchronization signal Hsync and a vertical synchronization signal Vsync, it outputs corresponding control signals to the first driving circuit 16, the gate driving circuit 18 and the power supply circuit 22. The power supply circuit 22 is used for providing a plurality of level voltages V0 to Vn and for selectively transmitting the level voltages V0 to Vn to the first driving circuit 16 according to display data 32 and the control signals outputted from the control circuit 14. The first driving circuit 16 can receive the level voltages and respectively drive each data line 24 according to the received level voltages and the control signals outputted from the control circuit 14, whereby controlling the voltage difference between the two ends of each capacitor 30 and therefore changing the gray level of each pixel on the LCD panel 12. The gate driving circuit 18 can respectively output scanning pulses to the gate lines 26 according to the corresponding signals generated by the control circuit 14, whereby turning "on" or "off" the transistors 28.

U.S. Patent Publication No. 2003/0234757, published on Dec. 25, 2003, discloses a first driving circuit 16 as shown in FIG. 2. Now referring to FIGS. 1 and 2, FIG. 2 shows a detailed circuit of the first driving circuit 16 connected to the power supply circuit 22 and one row of transistors 28. The power supply circuit 22 comprises a plurality (only six shown in FIG. 2) of multiplexers MUX3 to MUX8. According to the control signals D3 to D8 outputted from the control circuit 14, each of the multiplexers MUX3 to MUX8 can select one of the level voltages V0 to Vn from a voltage bus 66 and then output the selected level voltage to the first driving circuit 16. The first driving circuit 16 comprises a plurality of operational amplifiers 44 and a plurality of switches 78 for controlling the current paths, wherein each switch 78 is respectively disposed between each operational amplifier 44 and each data line 24 (e.g. DL3 to DL8). When the gate line GL3 receives one scanning pulse from the gate driving circuit 18, each transistor 28 can be turned "on"; meanwhile, each operational amplifier 44 receives one of the level voltages V0 to Vn respectively from each multiplexer MUX3 to MUX8 and then drives each data line 24 to the voltage level of each received level voltage, whereby controlling the voltage difference between the two ends of each capacitor 30 and thus changing the gray level of each pixel on the LCD panel 12.

However, since the operational amplifiers 44 have different offsets affecting the actual output voltages, the voltage levels outputted from the operational amplifiers 44 are different even if the operational amplifiers 44 receive the same level voltage from the multiplexers MUX3 to MUX8; therefore, the voltage differences between the two ends of the capacitors 30 are different, which may cause uneven display under the same gray level and thus deteriorate the display quality. Accordingly, the switches 78 are utilized to solve the problem of uneven display.

FIG. 3 shows the voltage waveforms at the output terminal VM of the multiplexer MUX3 and the data line DL3 shown in FIG. 2 for illustrating the operation of the first driving circuit 16. It is assumed that the initial voltages of the output terminals VM of the multiplexers MUX3 to MUX 8 and the data lines DL3 to DL8 are Vn, and the target voltages of the same are V0; further, the scanning line GL3 receives one scanning pulse to turn "on" the transistors 28 arranged at the same row.

During the time t0 to t1, the switch 78 is switched to electrically connect the terminals E1 and E2 such that the operational amplifier 44 can drive the data line DL3 from the voltage Vn toward V0 according to the voltage change at the output terminal VM of the multiplexer MUX3.

During the time t1 to t2, the switch 78 is switched to electrically connect the terminals E1 and E3 such that the data line DL3 can receive the level voltage V0 directly from the output terminal VM of the multiplexer MUX3. In this period, all the data lines DL3 to DL8 receive and are directly driven by the level voltages V0, which are respectively selected from the voltage bus 66 through the multiplexers MUX3 to MUX 8, such that the uneven display caused by different offsets of the operational amplifiers can be eliminated; further, the data lines DL3 to DL8, therefore, can be precisely driven to the level voltage.

However, the operational amplifier generally has a good driving ability and is able to pull the voltage level of the data line DL3 rapidly and closely toward the voltage level of the level voltage V0 prior to time t1. Therefore, the period, i.e. time t0 to t1, is too long for the operational amplifier to drive the data line DL3, which may cause additional power consumption of the operational amplifier.

Now referring to FIGS. 1 and 4, FIG. 4 shows a schematic diagram of the gate driving circuit 18 connected to one column of transistors 28. The gate driving circuit 18 comprises a shift registering circuit 80, a level shifting circuit 82 and a buffering circuit 84. The shift registering circuit 80 is composed of a plurality of shift registers 81 series-connected to each other, and used for receiving a gate starting pulse Y and a gate shifting clock CLKY from the control circuit 14 and then sequentially outputting the gate starting pulse Y to the level shifting circuit 82 according to the gate shifting clock CLKY. Each of the shift registers 81 can be implemented by D-type latch. The level shifting circuit 82 comprises a plurality of level shifters 83 for sequentially receiving the gate starting pulse Y and converting the received gate starting pulse Y into a scanning pulse, which is appropriate to drive the gate of the corresponding transistor 28. The buffering circuit 84 comprises a plurality of buffers 85 for sequentially receiving the scanning pulse and outputting the received scanning pulse to the gate of the corresponding transistor 28 through the gate lines GL0 to GLn whereby sequentially turning "on" the transistors 28.

However, in the gate driving circuit 18, the scanning pulses outputted by the buffers 85 are not identical and have different driving capacities. Therefore, when the gates of the transistors 28 receive the scanning pulses having different driving capacities, especially having weaker driving capacities, the capacitors 30 may be charged to different voltage levels and thus cause uneven display under the same gray level.

Accordingly, the present invention provides a circuit and method for driving a display panel so as to solve the above-mentioned problems in the art.

SUMMARY OF THE INVENTION

It is an object of the present invention to provide a circuit and method for driving a display panel, which can reduce the unnecessary power consumption of the source driving circuit and solve the cross talk problem of the display panel caused by the source driving circuit and the problem of the uneven display caused by the gate driving circuit.

In order to achieve the above object, the present invention provides a circuit for driving a display panel, comprising a source driving circuit having a plurality of driving units for driving the display panel according to display data; at least one of the driving units has a buffer and a switch circuit wherein the buffer has an input terminal and an output terminal, and the switch circuit is coupled to the buffer for selectively and electrically connecting the output terminal of the buffer and the display panel, electrically connecting the input terminal of the buffer and the display panel, or electrically disconnecting the buffer and the display panel.

The present invention also provides a circuit for driving a display panel, comprising a buffer having an input terminal and an output terminal; a switch circuit coupled to the buffer for selectively and electrically connecting the output terminal of the buffer and the display panel or electrically connecting the input terminal of the buffer and the display panel; and an adjustable voltage reference circuit coupled to the buffer for adjusting the driving capacity of the buffer.

The present invention also provides a method for driving a display panel having a driving circuit which comprises at least one buffer having an input terminal and an output terminal; the present method comprises following steps: electrically disconnecting the buffer and the display panel; electrically connecting the output terminal of the buffer and the display panel; and electrically connecting the input terminal of the buffer and the display panel.

According to the circuit and method of the present invention, the buffer can be turned "off" while the switch circuit electrically disconnects the buffer and the display panel whereby reducing the power consumption of the buffer in the source driving circuit.

BRIEF DESCRIPTION OF THE DRAWINGS

Other objects, advantages, and novel features of the present invention will become more apparent from the following detailed description when taken in conjunction with the accompanying drawings.

DETAILED DESCRIPTION OF THE PREFERRED EMBODIMENT

Figure 1:
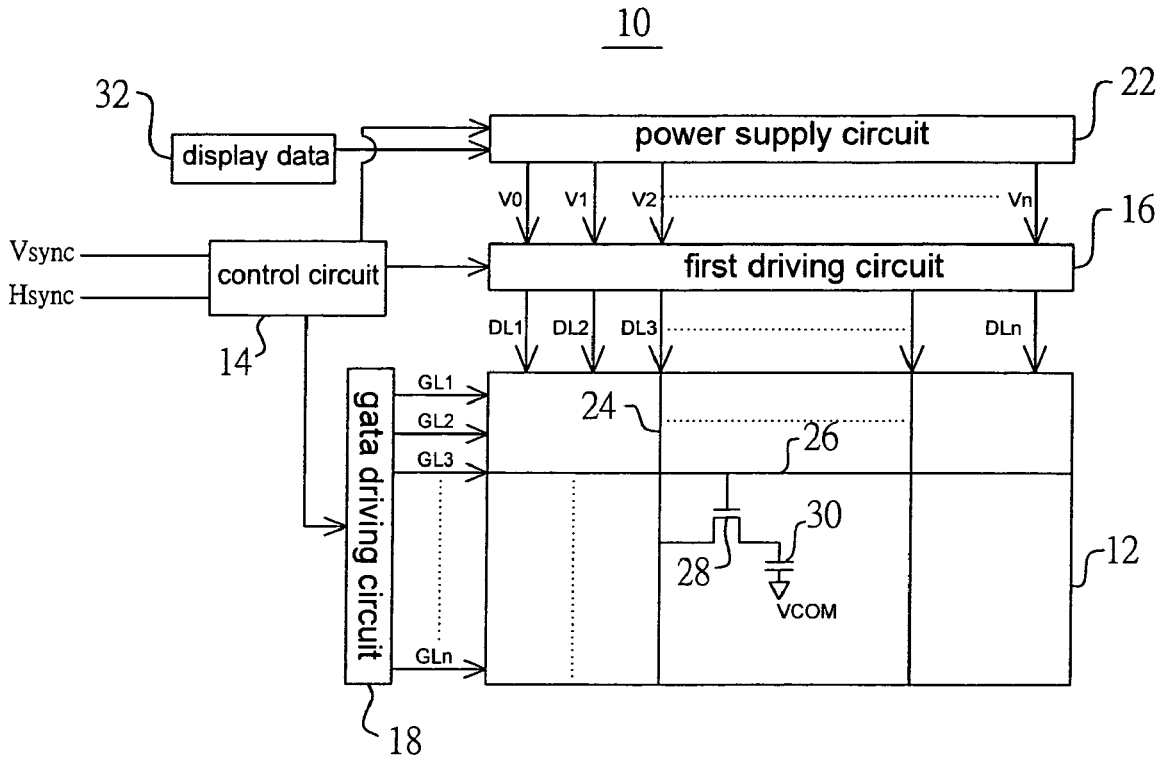
FIG. 1 (PRIOR ART)
FIG. 1 shows a schematic diagram of a conventional TFT LCD device.
Figure 2:
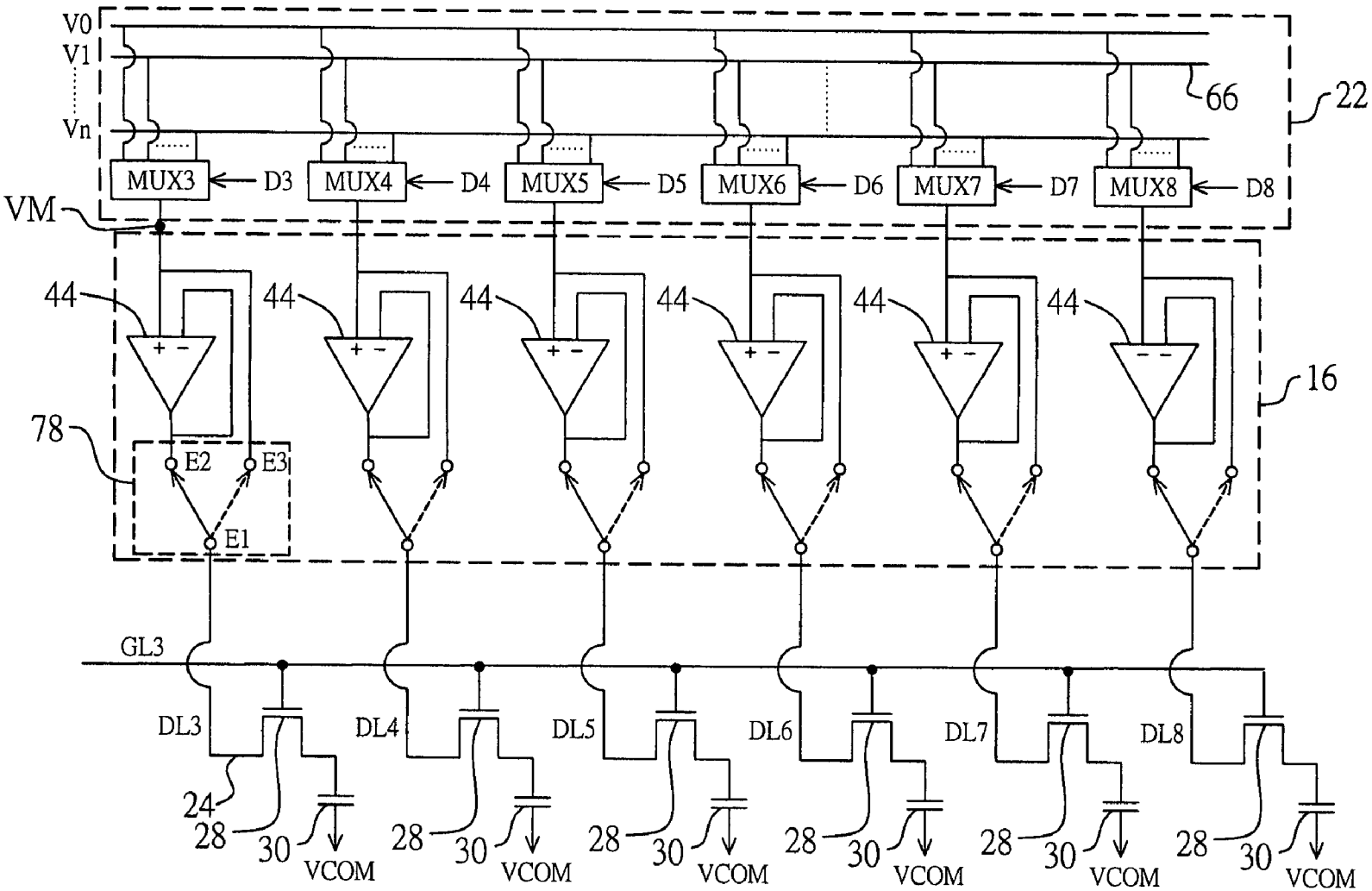
FIG. 2 (PRIOR ART)
FIG. 2 shows a detailed circuit of a conventional first driving circuit connected to a power supply circuit and one row of transistors.
Figure 3:
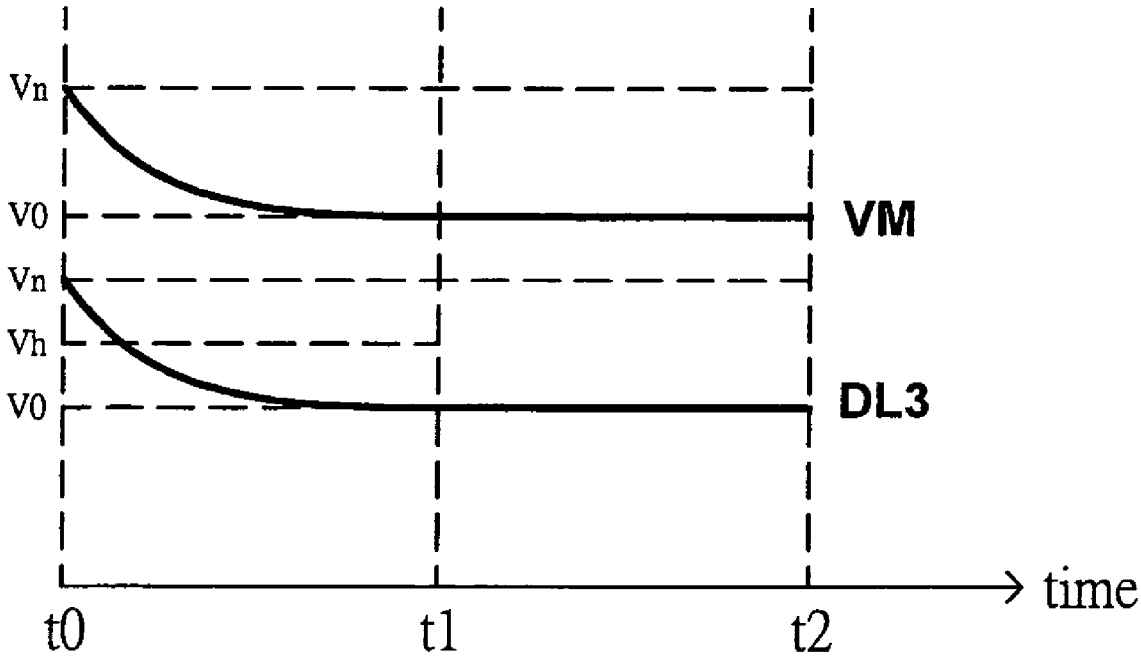
FIG. 3 (PRIOR ART)
FIG. 3 shows the voltage waveforms at the output terminal VM and the data line DL3 shown in FIG. 2 for illustrating the operation of the first driving circuit.
Figure 5:
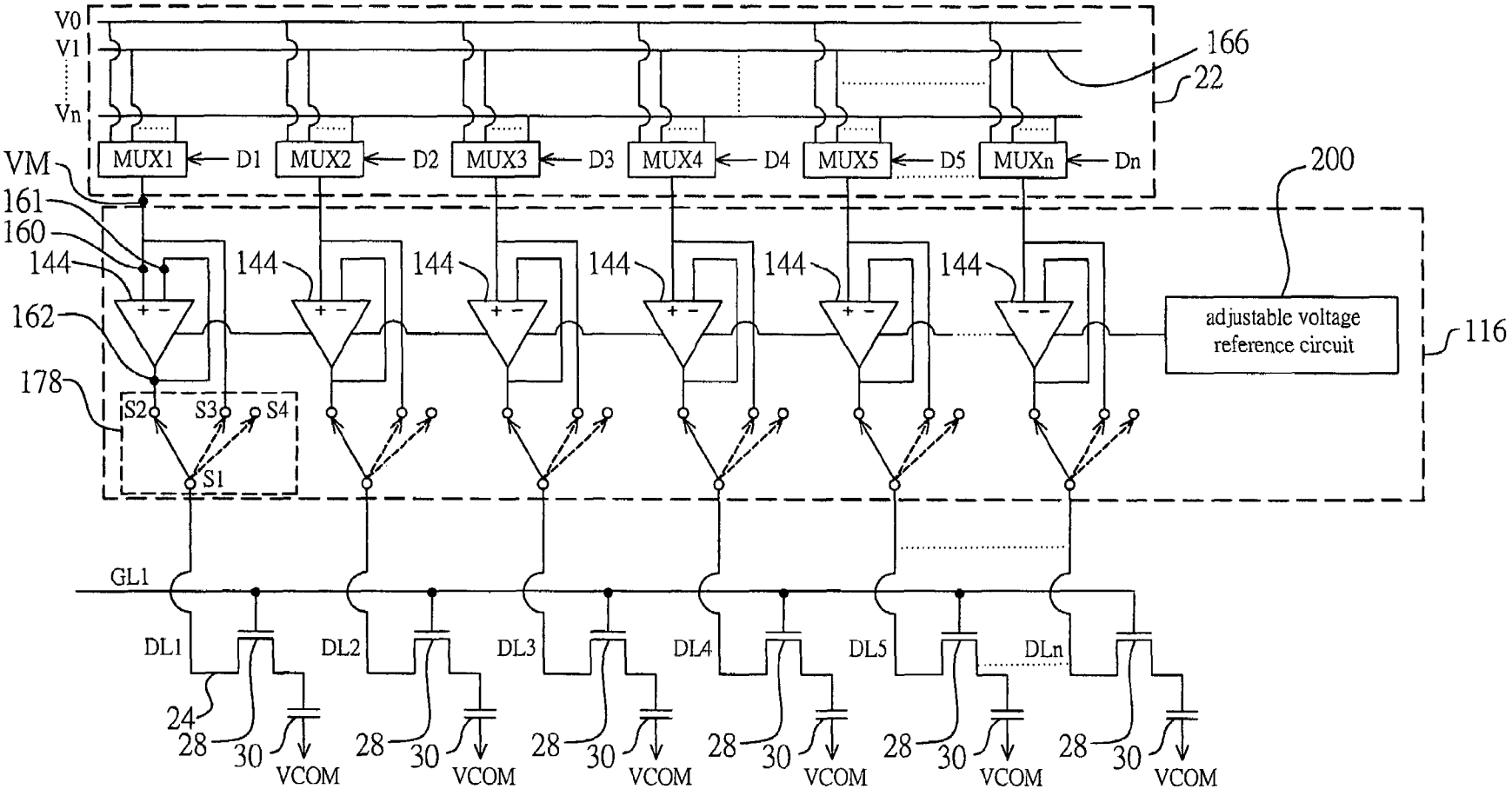
FIG. 5 shows a detailed circuit of a first driving circuit connected to a power supply circuit and one row of transistors according to one embodiment of the present invention.

Now referring to FIGS. 1, 2 and 5, FIG. 5 shows a detailed circuit of a first driving circuit 116 connected to a power supply circuit 22 and one row of transistors 28 according to one embodiment of the present invention. The first driving circuit 116 of the present invention replaces the first driving circuit 16 shown in FIG. 2. In addition, the same elements shown in FIGS. 5 and 2 are indicated by the same numerals.

The first driving circuit 116 comprises a plurality of operational amplifiers 144 and a plurality of switch circuits 178, wherein each operational amplifier and each switch circuit are constructed as one driving unit. Each operational amplifier 144 functions as a buffer and has a non-inverting input 160 being the input of the driving unit, an inverting input 161, and an output 162 negatively fed back to the inverting input 161. Each switch circuit 178 is respectively disposed between each operational amplifier 144 and each transistor 28 for controlling the current paths. Each of the switch circuits 178 has one end electrically coupled to each of corresponding data lines 24 (i.e. DL1 to DLn) and thus electrically coupled to each column of transistors 28 on the LCD panel 12 through the corresponding data lines 24; further, each of the switch circuits 178 is used for selectively and electrically connecting the output 162 of each corresponding operational amplifier and each data line 24 (i.e. electrically connecting the terminals S2 and S1), electrically connecting the non-inverting input 160 of each corresponding operational amplifier (i.e. the output terminal of each corresponding multiplexer) and the data line 24 (i.e. electrically connecting the terminals S3 and S1), and electrically disconnecting the non-inverting input 160 and output 162 of each corresponding operational amplifier and the data line 24 (i.e. electrically connecting the terminals S4 and S1).

Figure 6:
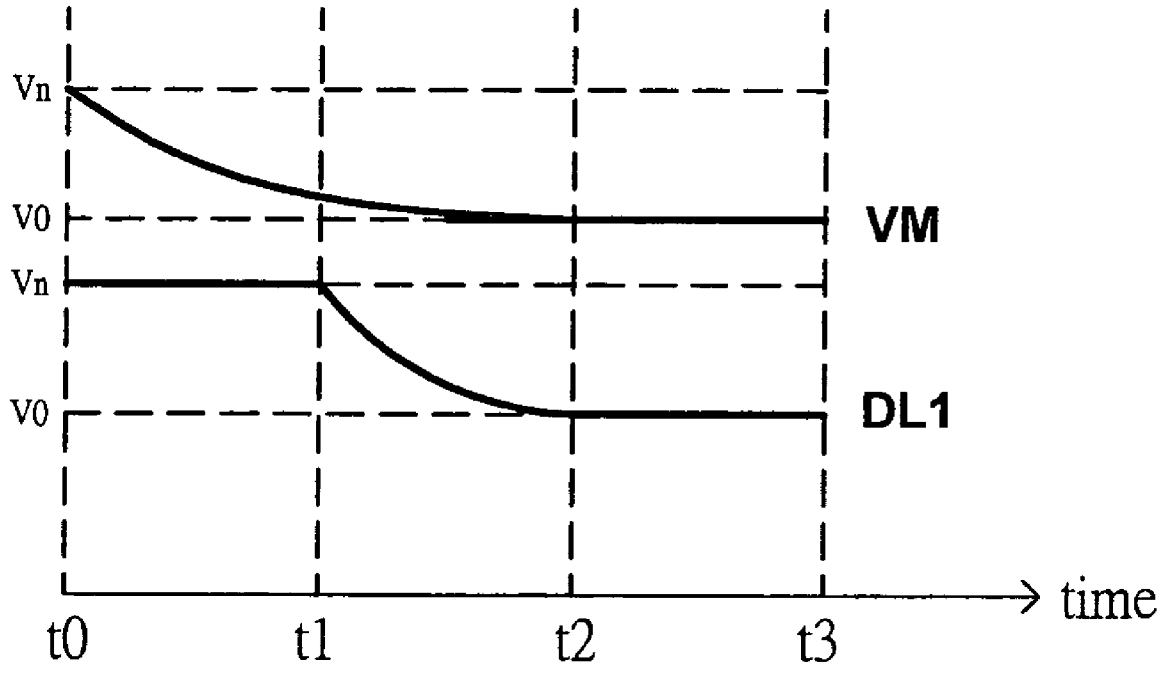
FIG. 6 shows the voltage waveforms at the output terminal of one multiplexer and one data line shown in FIG. 5 for illustrating the operation of the first driving circuit according to the present invention.

FIG. 6 shows the voltage waveforms at the output terminal VM of the multiplexer MUX1 and the data line DL1 shown in FIG. 5 for illustrating the operation of the first driving circuit 116 according to the present invention. It is assumed that the initial voltage of the output terminal VM and the data line DL1 is Vn, and the target voltage of the same is V0; further, the scanning line GL1 receives a scanning pulse to turn "on" the transistors 28 at the same row.

During the time t0 to t1, the switch circuit 178 is switched to electrically connect the terminals S1 and S4 such that the switch circuit 178 is electrically disconnected to the non-inverting input 160 and the output 162 of the operational amplifier 144 and thus kept in a floating state. In this period, the multiplexer MUX1 receives the level voltage V0 from the voltage bus 166; the voltage Vn at the output terminal VM is pulled down toward voltage V0; and the voltage Vn at the data line DL1 is maintained.

During the time t1 to t2, the switch circuit 178 electrically connects the terminals S1 and S2 such that the output 162 of the operational amplifier 144 is electrically connected to the data line 24. In this period, the voltage level at the output terminal VM of the multiplexer MUX1 is close to the voltage V0; in addition, since the output 162 of the operational amplifier 144 is electrically connected to the data line DL1 through the switch circuit 178, the operational amplifier 144 can rapidly pull the voltage Vn at the data line DL1 toward the voltage level at the output terminal VM of the multiplexer MUX1.

During the time t2 to t3, the switch circuit 178 electrically connects the terminals S1 and S3 such that the non-inverting input 160 of the operational amplifier 144 is electrically connected to the data line 24. In this period, the voltage level at the output terminal VM of the multiplexer MUX 1 is equal to the voltage V0; in addition, since the output terminal VM of the multiplexer MUX1 (i.e. non-inverting input 160 of the operational amplifier 144) is electrically connected to the data line DL1 through the switch circuit 178, the data line DL1 can receive the voltage V0 directly from the output terminal VM of the multiplexer MUX1 such that the data line DL1 can be precisely driven to the target voltage V0. Meanwhile, the data line DL1 also charge sharing with the data lines having the same voltage level V0 through the voltage bus 166. In this manner, the uneven display caused by different offsets of the operational amplifiers can be eliminated.

It should be noted that the time period t0 to t3 is equal to the pulse period of the scanning pulse received by the scanning line GL1, and referred to as a scanning line period.

In the first driving circuit 116, the output 162 of the operational amplifier 144 is kept in a floating state while the switch circuit 178 electrically connects the terminals S1 and S4 during the time t0 to t1 and electrically connects the terminals S1 and S3 during the time t2 to t3; therefore, the driving time (i.e. time t1 to t2) of the operational amplifier 144 for driving the data line 24 is shorter than that in the prior art. In this embodiment, the operational amplifier 144 can be turned "off" during the floating state of the output terminal 162, i.e. during the time t0 to t1 and the time t2 to t3, such that the power consumption of the operational amplifier 144 can be reduced. In addition, the time t0 to t1 should be longer than an appropriate value such that the period, during which the operational amplifier 144 is turned off, can be longer enough so as to achieve a desirable result of reducing the power consumption. In this embodiment, the time t0 to t1 should be longer than, for example, 3% of the time t0 to t3 or 3% of the current time t0 to the next time t0.

The first driving circuit 116 according to the present invention further comprises an adjustable voltage reference circuit 200 (shown in FIG. 5), which is electrically connected to each operational amplifier 144. The adjustable voltage reference circuit 200 is used for adjusting the driving capacity of each operational amplifier 144. For example, the adjustable voltage reference circuit 200 can be electrically coupled to a D/A (digital to analog) converting circuit through an $I^2C$ interface, so as to adjust the voltage used for controlling the bias current of the operational amplifier 144; in this manner, the driving capacity of the operational amplifier 144 can be adjusted by controlling the bias current, whereby ensuring that the operational amplifier 144 has sufficient driving capacity for driving the voltage level at the data line toward a target voltage within the time t1 to t2 as shown in FIG. 6, and thus avoiding the cross talk problem of the display panel. In other word, the time t1 to t2 can be shorter when the driving capacity of the operational amplifier 144 is stronger.

Figure 4:
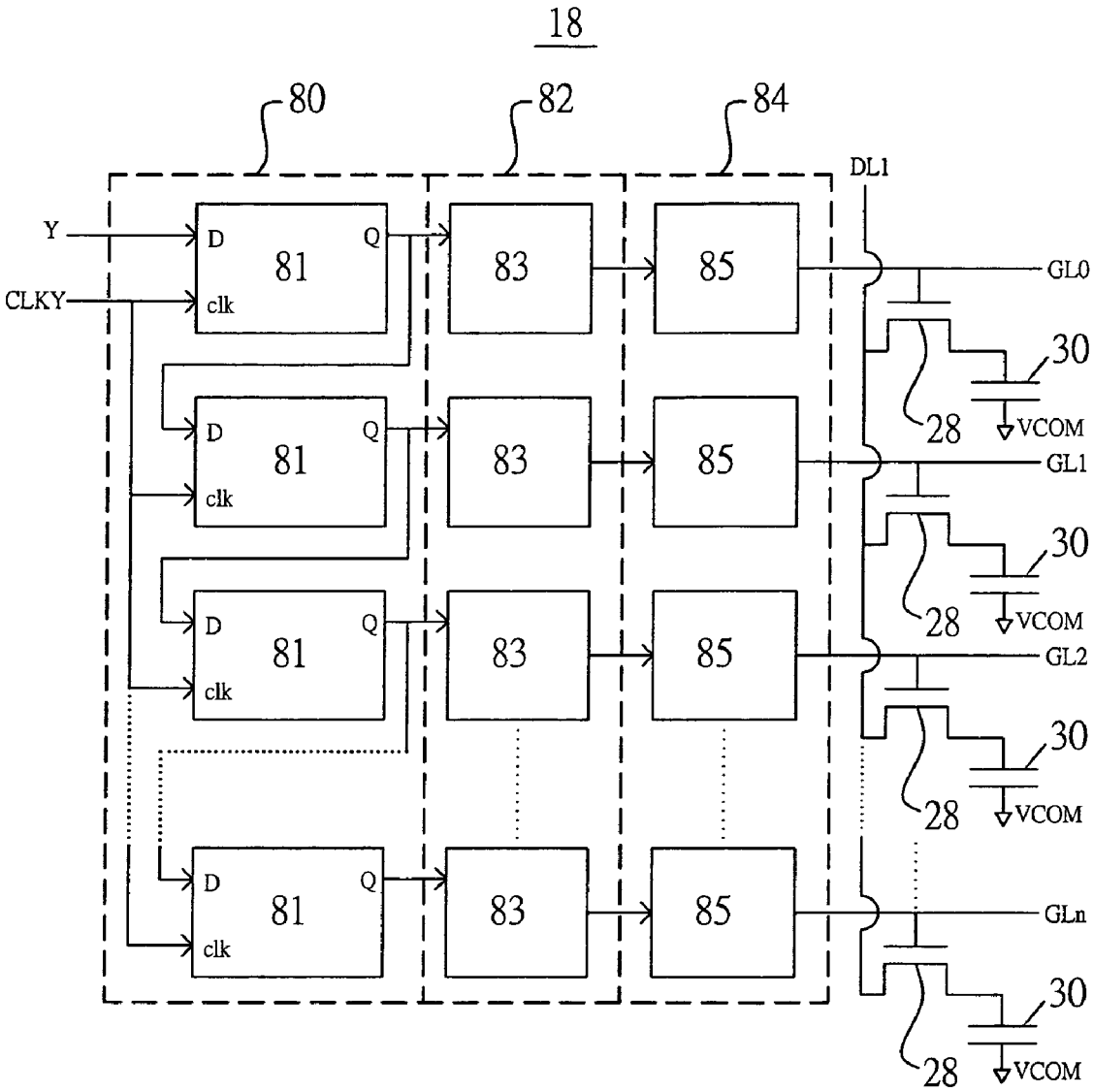
FIG. 4 (PRIOR ART)
FIG. 4 shows a schematic diagram of a conventional gate driving circuit connected to one column of transistors.
Figure 7:
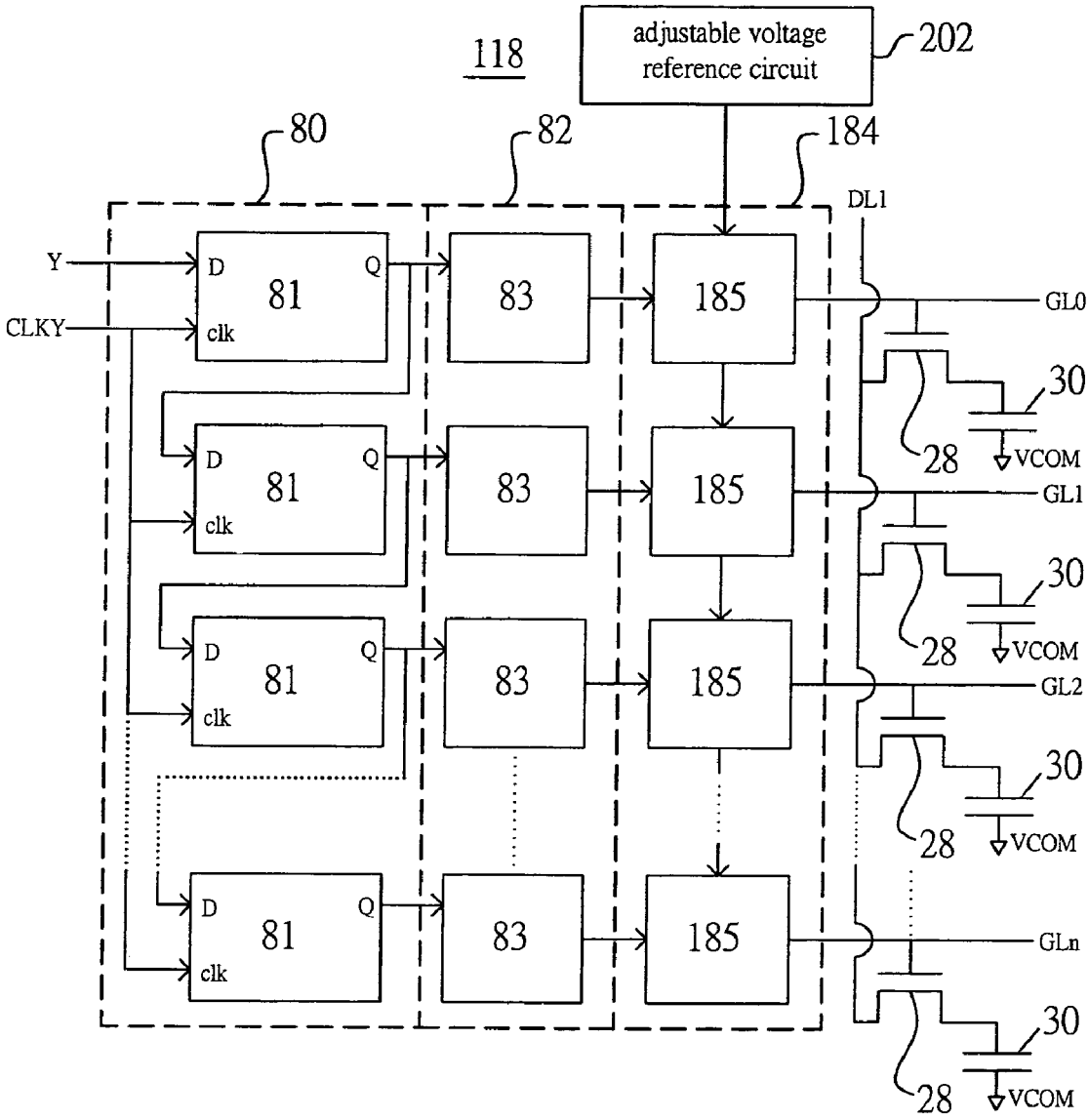
FIG. 7 shows a schematic diagram of a gate driving circuit connected to one column of transistors according to one embodiment of the present invention.

Now referring to FIGS. 1, 4 and 7, FIG. 7 shows a schematic diagram of a gate driving circuit 118 connected to one column of transistors 28 (only four shown in FIG. 7) according to one embodiment of the present invention. The same elements shown in FIGS. 7 and 4 are indicated by the same numerals. The gate driving circuit 118 is a detailed schematic circuit of the gate driving circuit 18 as shown in FIG. 1 The gate driving circuit 118 comprises a shift registering circuit 80, a level shifting circuit 82, a buffering circuit 184 and an adjustable voltage reference circuit 202. The LCD device 10 shown in FIG. 1 and the shift registering circuit 80 and the level shifting circuit 82 shown in FIG. 4 have been illustrated and will not be further described below.

The buffering circuit 184 has a plurality of buffers 185 for sequentially receiving the scanning pulse from the level shifting circuit 82 and outputting the received scanning pulse to the gate of the corresponding transistor 28 through the gate lines GL0 to GLn whereby sequentially turning "on" each row of the transistors 28.

According to the gate driving circuit 118 of the present invention, the adjustable voltage reference circuit 202 is electrically connected to each buffer 185 of the buffering circuit 184. The adjustable voltage reference circuit 202 is used for adjusting the driving capacity of each buffer 185 so as to avoid uneven display under the same gray level. For example, the adjustable voltage reference circuit 202 can be electrically coupled to a D/A (digital to analog) converting circuit through an $I^2C$ interface, so as to adjust the voltages used for controlling the bias current of the buffer 185; in this manner, the driving capacity of each buffer 185 can be adjusted by controlling the bias current.

It should be understood that the first driving circuit 116 and the gate driving circuit 118 according to the embodiments of the present invention can be applied to drive LCD panels of various LCD devices, e.g. LCD panels having an upper and a lower glass substrates and LCOS (liquid crystal on silicon) panels.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A circuit for driving a display panel, comprising:

a source driving circuit having a plurality of driving units configured to drive the display panel according to display data, wherein at least one of the driving units comprises:

a first buffer having an input terminal and an output terminal, and a switch circuit having a first terminal, a second terminal, a third terminal and a fourth terminal, the first terminal coupled to the display panel, the second terminal coupled to the output terminal of the first buffer, the third terminal coupled to the input terminal of the first buffer, and the fourth terminal being floated, the switch circuit configured to sequentially, electrically connect the first terminal to the fourth terminal, electrically connect the first terminal and the second terminal, and electrically connect the first terminal and the third terminal; and a gate driving circuit configured to drive the display panel according to a control signal.

2. The circuit for driving a display panel as claimed in claim 1, further comprising an adjustable voltage reference circuit for adjusting the driving capacity of the first buffer.

3. The circuit for driving a display panel as claimed in claim 2, wherein the first buffer has a bias current, and the first adjustable voltage reference circuit is used for adjusting the bias current whereby adjusting the driving capacity of the first buffer.

4. The circuit for driving a display panel as claimed in claim 1, wherein the time period for electrically connecting the first terminal to the fourth terminal is longer than or equal to 3% of the time period for electrically connecting the first terminal and the second terminal, electrically connecting the first terminal and the third terminal, and electrically connecting the first terminal to the fourth terminal.

5. The circuit for driving a display panel as claimed in claim 1, wherein the display panel is an LCOS (liquid crystal on silicon) panel.

6. The circuit for driving a display panel as claimed in claim 1, wherein the gate driving circuit further comprises:

at least one second buffer for driving the display panel; and an adjustable voltage reference circuit for adjusting the driving capacity of the second buffer.

7. The circuit for driving a display panel as claimed in claim 6, wherein the second buffer has a bias current, and the adjustable reference circuit is used for adjusting the bias current whereby adjusting the driving capacity of the second buffer.

8. The circuit for driving a display panel as claimed in claim 1, wherein the input terminal of the first buffer is coupled to a multiplexer.

9. The circuit for driving a display panel as claimed in claim 1, wherein the input terminal of the first buffer is coupled to a voltage bus.

10. The circuit for driving a display panel as claimed in claim 1, wherein the first buffer is turned off while the first terminal electrically connects to the fourth terminal.

11. A circuit for driving a display panel, comprising:

a buffer having an input terminal and an output terminal;

a switch circuit having a first terminal, a second terminal, a third terminal and a fourth terminal, the first terminal coupled to the display panel, the second terminal coupled to the output terminal of the buffer, the third terminal coupled to the input terminal of the buffer, and the forth terminal being floated, the switch circuit configured to sequentially, electrically connect the first terminal to the fourth terminal, electrically connect the first terminal and the second terminal, and electrically connect the first terminal and the third terminal; and an adjustable voltage reference circuit coupled to the buffer and configured to adjust the driving capacity of the buffer.

12. The circuit for driving a display panel as claimed in claim 11, wherein the buffer has a bias current, and the adjustable voltage reference circuit is configured to adjust the bias current and thereby adjust the driving capacity of the buffer.

13. The circuit for driving a display panel as claimed in claim 11, wherein the display panel is an LCOS (liquid crystal on silicon) panel.

14. A method for driving a display panel, the display panel having a driving circuit which comprises at least one buffer having an input terminal and an output terminal, and at least one switch circuit having a first terminal, a second terminal, a third terminal and a fourth terminal, the first terminal of each switch circuit coupled to the display panel, the second terminal of each switch circuit coupled to the output terminal of corresponding buffer, the third terminal of each switch circuit coupled to the input terminal of corresponding buffer, the fourth terminal of each switch circuit being floated, the method comprising the following steps:

first, electrically connecting the first terminal to the fourth terminal;

electrically connecting the first terminal and the second terminal; and lastly, electrically connecting the first terminal and the third terminal.

15. The method for driving a display panel as claimed in claim 14, further comprising a step of turning off the buffer.

16. The method for driving a display panel as claimed in claim 14, wherein the time period for electrically connecting the first terminal and the second terminal is determined according to the driving capacity of the buffer.

17. The method for driving a display panel as claimed in claim 16, wherein the buffer has a bias current and the method further comprises a step of adjusting the bias current whereby changing the driving capacity of the buffer.

18. The method for driving a display panel as claimed in claim 14, further comprising a step of receiving a level voltage by the input terminal of the buffer.

19. The method for driving a display panel as claimed in claim 14, wherein the time period for electrically connecting the first terminal to the fourth terminal is longer than or equal to 3% of the time period for electrically connecting the first terminal and the second terminal, electrically connecting the first terminal and the third terminal, and electrically connecting the first terminal to the fourth terminal.

* * * * *